US005817967A

United States Patent [19]

Simon

[11] Patent Number: 5,817,967

[45] Date of Patent: Oct. 6, 1998

[54] SMALL OR MEDIUM CALIBER MULTI-BARREL AUTOMATIC WEAPON OF THE GATLING TYPE, NOTABLY DESIGNED FOR FIRING TELESCOPED MUNITIONS

[75] Inventor: Georges Simon, Saint Germain du Puy, France

[73] Assignee: CTA International, France

[21] Appl. No.: 765,824

[22] PCT Filed: May 19, 1995

[86] PCT No.: PCT/FR95/00665

§ 371 Date: May 1, 1997

§ 102(e) Date: May 1, 1997

[87] PCT Pub. No.: WO96/36845

PCT Pub. Date: Nov. 21, 1996

[51] Int. Cl.[6] ..... F41A 9/36

[52] U.S. Cl. ..... 89/12; 89/13.05

[58] Field of Search ..... 89/12, 13.05, 9

[56] References Cited

U.S. PATENT DOCUMENTS

| | | | |
|---|---|---|---|
| 2,959,106 | 11/1960 | O'Brien | 89/126 |
| 3,101,027 | 8/1963 | Brogan | 89/12 |
| 3,222,989 | 12/1965 | Kamp | 89/155 |
| 3,668,637 | 6/1972 | Tan | 89/12 |
| 4,216,698 | 8/1980 | Chiabrandy | 89/12 |
| 4,278,008 | 7/1981 | Smith et al. | 89/156 |
| 4,342,253 | 8/1982 | Kirkpatrick et al. | 89/12 |

FOREIGN PATENT DOCUMENTS

| | | |
|---|---|---|
| 1578007 | 8/1971 | Germany . |
| 3627891 | 2/1988 | Germany . |

*Primary Examiner*—Stephen M. Johnson
*Attorney, Agent, or Firm*—Parkhurst & Wendel

[57] ABSTRACT

A small or medium-caliber multi-barrel automatic weapon of the GATLING type, notably designed to fire telescoped munitions, having a loading and firing system (SC) having several pivoting chambers (20). Each chamber is mounted pivoting around a stay (30), is associated with a barrel of the weapon and moves from a loading area (ZC) to a firing area (ZT), said chamber (20) being guided during its movement by guiding means formed of a fixed inner cam (32) and a fixed outer cam (34) which are separated from one another by an even distance corresponding to the outer diameter of the chambers (20).

15 Claims, 3 Drawing Sheets

SMALL OR MEDIUM CALIBER MULTI-BARREL AUTOMATIC WEAPON OF THE GATLING TYPE, NOTABLY DESIGNED FOR FIRING TELESCOPED MUNITIONS

The invention relates to a small or medium-caliber multi-barrel automatic weapon of the GATLING type, notably designed for firing telescoped ammunition, comprising at least an ammunition feed system and a loading and firing system having several chambers, a weapon in which the loading and firing system is housed inside a body or bodies of the weapon and comprises a loading unit mounted mobile in rotation around a fixed central shaft and integral in rotation with the weapon barrels, and in which each chamber, during a full rotation of the loading unit, moves from a loading position where the chamber is open and laterally offset with respect to the barrels of the weapon in order to be able to load a munition, to a firing position where the chamber is closed and is axially aligned with one of the weapon barrels so as to allow the munition to be fired, said chamber being guided in its movement by guiding means.

The scope of the invention is generally that of small or medium-caliber automatic weapons having a high rate of fire, in the region of 1000 rounds per minute and per barrel, which are notably used for close-range anti-missile defence.

Generally, the loading and firing system in a multi-barrel weapon using conventional ammunition comprises a sliding breech which closes off the rear end of a loading chamber upon firing. After firing, the breech is opened in order to extract, from the rear of the chamber, the case of the munition fired.

Given that a telescoped munition has an elongated body with a regular, generally cylindrical, outer profile, advantage can be taken of this shape in weapons having only one barrel and a pivoting chamber to automatically eject, from the front of the chamber, the case of a munition previously fired which is pushed through by the loading of a new munition in the chamber. Such an advantage can also be exploited in a multi-barrel automatic weapon of the GATLING type in order to simplify the structure of the loading and firing system. In fact, in this case, it would be possible to eliminate the sliding breech, as is envisaged moreover is document U.S. Pat. No. 3,688,637.

In this anterior document, the loading and firing system notably comprises several chambers interconnected so as to form a closed, hinged chain. This chain, at one end, winds round a star-shaped revolving unit which also carries the weapon barrels, whereas the chain, at its other end, is guided by a cam groove.

In considering the direction of rotation of the star-shaped revolving unit, a chamber which is approaching this revolving unit contains a munition to be fired, a chamber which is moving away from the unit contains the case of the munition having just been fired, and a chamber which is travelling along the cam groove located beyond the revolving unit receives a new munition which, during loading, pushes through and ejects the afore-mentioned case.

However, such a loading and firing system is designed with a number of chambers greater than the number of weapon barrels. As a result the loading and firing unit is relatively cumbersome and heavy which requires a suitable motor element to overcome the inertia of the loading unit.

SUMMARY OF THE INVENTION

The aim of the invention is to overcome the afore-mentioned drawbacks and proposes to this end a small or medium-caliber multi-barrel automatic weapon of the afore-mentioned type which is characterised in that each chamber of the weapon is mounted pivoting around a stay integral with the loading unit of the loading and firing system, and which is functionally connected to a barrel of the weapon, and in that the guiding means of the chambers are formed of a fixed inner cam, carried by the said central shaft, and a fixed outer cam provided on the inner surface of the weapon body and which encompasses the inner cam whilst remaining separated from the latter by a distance roughly corresponding to the outer diametre of the chambers.

The number of loading chambers is equal to the number of barrels of the weapon, this number being between 2 and 8 (normal maximum number).

Generally, each chamber is formed of a cylindrical body whose periphery carries two axially aligned bosses, both of which are drilled with a hole to allow the stay associated with the chamber to pass through freely.

According to one embodiment of the invention, the fixed inner cam is, for example, formed of two disks carried by the fixed central shaft and separated from one another by a distance which is shorter than the length of the chambers, each disk defining at its periphery a cam groove around the fixed central shaft which supports the loading unit of the loading and firing system in rotation.

According to one example of the invention, the outer cam is, for example, formed of two ribs made on the inner wall of the body of the weapon and separated from one another by a distance which is shorter than the length of the chambers, each rib defining by the edge of its free end a cam groove which encompasses one of the disks of the afore-mentioned fixed inner cam.

Generally, the two fixed inner and outer cams mark out four areas through which each chamber passes one after the other during the full rotation of the loading unit of the afore-mentioned loading and firing system:

(1) a loading area in which the chamber is open and laterally offset with respect to the associated barrel of the weapon in order to receive a munition, (2) a closing area in which the chamber gradually closes as it approaches the associated barrel, (3) a firing area in which the chamber is axially aligned with the associated barrel of the weapon, and (4) an opening area in which the chamber gradually opens as it moves away from the associated barrel.

Thus, each chamber is functionally linked to one of the barrels of the weapon and to a stay, the guiding means making each chamber pivot around its associated stay following a cycle defined by the guiding means.

According to another characteristic of the invention, the loading unit of the loading and firing system is housed inside the body of the weapon, mounted to the rear of the loading chambers with respect to the weapon's line of fire and comprises, on its periphery, chutes extending in parallel to the fixed central shaft, evenly distributed around the said unit to receive the ammunition and working in conjunction with a fixed helicoidal ramp provided on the inner wall of the body of the weapon and designed to translate the munitions towards the chambers during rotation of the loading unit.

In operation, one of the chutes of the loading unit is axially aligned with one of the chambers when the latter moves through the above loading area marked out by the fixed inner and outer cams.

According to another characteristic of the invention, the ammunition feed system comprises a lateral inlet provided in the body of the weapon and located on a level with the loading unit, this inlet extends in parallel to the afore-mentioned fixed central shaft and is at least as long as a munition, this inlet allows the munition to pass through, one by one, between an ammunition magazine and the receiving chutes of the loading unit.

In order to take into account weapon recoil further to firing the munition, the length of the inlet located at the loading unit is greater than that of a munition.

According to another characteristic of the invention, the weapon also comprises a system to eject the cases of the munitions fired, this system being housed in the body of the weapon, located to the front of the chambers with respect to the line of fire of the weapon and comprising a unit mounted revolving around the afore-mentioned fixed central shaft.

According to another characteristic of the invention, the ejection unit comprises means to support the case at its periphery, one of these supports being axially aligned with that of the chamber located in the afore-mentioned loading area marked out by the fixed inner and outer cams.

According to one embodiment of the invention, the ejection unit is formed of two star-shaped wheels integral with the afore-mentioned fixed central shaft, fitted with notches and separated from one another by a distance shorter than the length of a case, two axially aligned notches of the two star-shaped wheels form a support to receive a case pushed through by a new munition introduced into the chamber which is located in the loading area marked out by the fixed inner and outer cams.

According to another characteristic of the invention, the ejection system also comprises a lateral outlet provided in the weapon body and located at a level with the ejection unit, this outlet extending in parallel to the afore-mentioned fixed central shaft and of a length at least equal to that of a case, and a fixed lever to eject a case outwards when its passes in front of the said outlet.

The stays which support the chamber ensures the cohesion of the revolving assembly of the weapon, this assembly comprising notably the loading unit, the chambers, the barrels and the ejection system. These stays extends in parallel to the fixed central shaft of the weapon, and it is possible for the number of chambers to be less than the number of stays.

Generally, the chamber itself receiving a telescoped munition can have a circular cross section or a polygonal cross section, for example square, to fire telescoped munition of a matching shape.

According to one important advantage of the invention, each loading chamber is associated with a barrel of the weapon and a stay, thereby enabling the design of a compact loading unit whose mass, volume and moment of inertia around the rotational shaft of the weapon are reduced.

BRIEF DESCRIPTION OF THE DRAWINGS

Other advantages, characteristics and particulars of the invention will become apparent from the explanatory description which will follow made with reference to the appended drawings, given merely by way of illustration and in which.

DETAILED DESCRIPTION OF THE PREFERRED EMBODIMENTS

Figure 1:
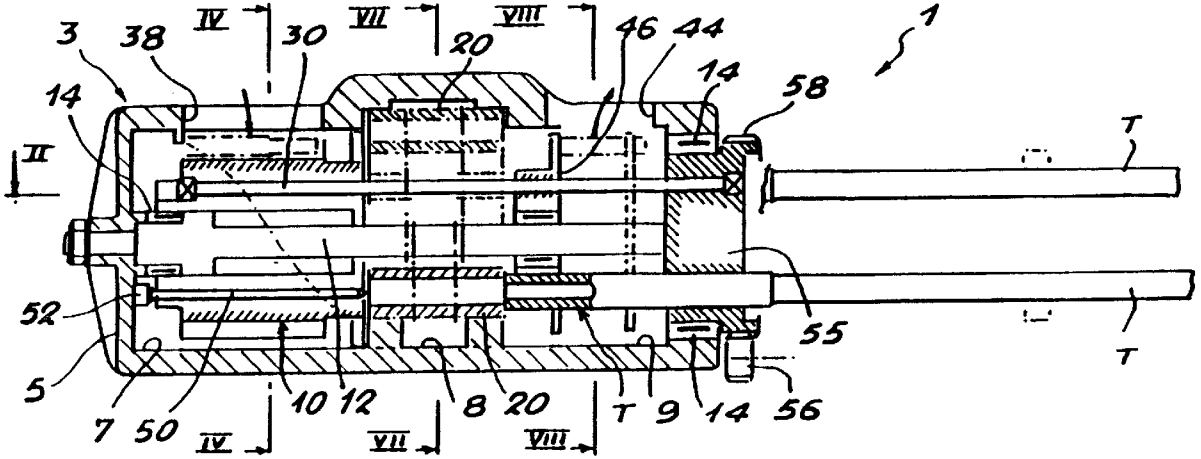
FIG. 1 is a longitudinal schematic section view of a weapon according to the invention.

The weapon 1 according to the invention such as represented diagrammatically in FIG. 1 is a small or medium-calibre multi-barrel automatic weapon of the GATLING type having a high rate of fire, and which is notably designed for firing telescoped munitions.

Figure 2:
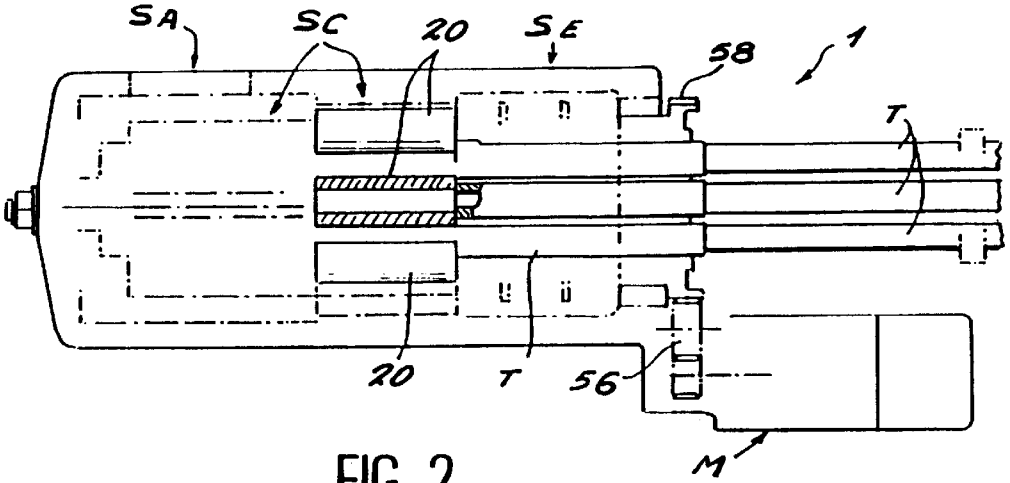
FIG. 2 is a section view along line II—II in FIG. 1.
Figure 3:
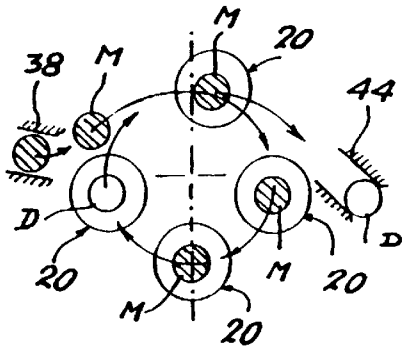
FIG. 3 is a diagrammatic view to explain the passage of a munition from its introduction to the ejection of the case.

In the example shown in FIGS. 1 and 2, this weapon 1 comprises an ammunition feed system SA, a loading and firing system SC, and a system SE to eject the cases of the munitions fired.

The weapon 1 comprises a hollow fixed body 3, of an elongated shape and of which one end or rear end is closed by a base 5. Three housings 7, 8 and 9 are successively marked out inside the body 3 of the weapon between its base 5 and its other end.

Figure 4:
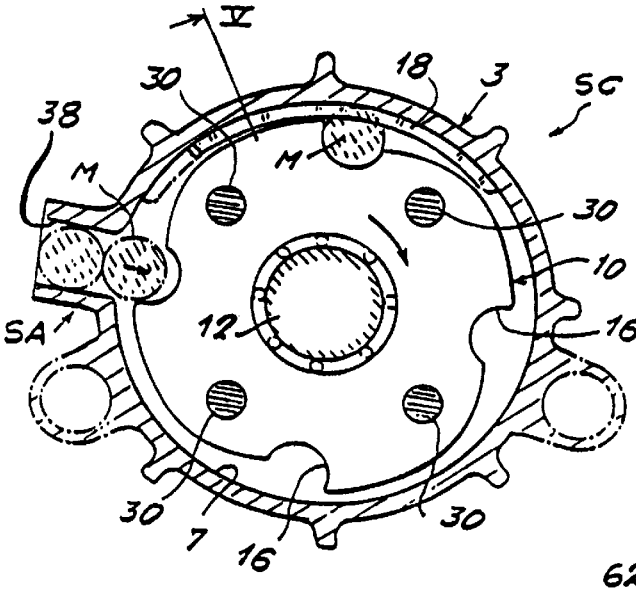
FIG. 4 is a section view along line IV—IV in FIG. 1.
Figure 5:
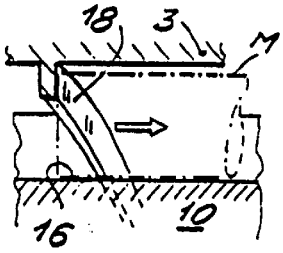
FIG. 5 is a partial top view of a detail shown by the arrow V in FIG. 4.
Figure 6:
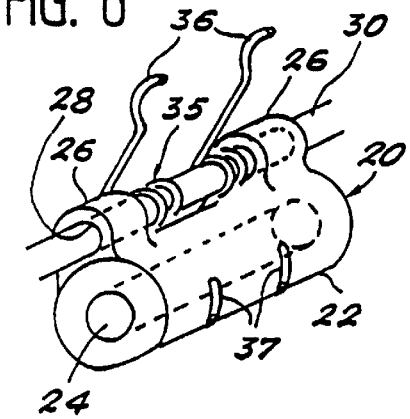
FIG. 6 is a perspective view of the loading chamber of the weapon.

With reference to FIGS. 1, 4 and 5, the loading and firing system SC comprises a loading unit 10 which is mounted revolving in a housing 7 in the body 3 of the weapon around a fixed central shaft 12 by means of bearings 14. The loading unit 10 is of a generally cylindrical shape and comprises, at its periphery, indentations forming chutes 16 to receive the munitions M. The chutes 16 each extend over the length of the loading unit 10 and are evenly distributed around this unit 10. The munitions M received in the chutes 16 cooperate with a fixed helicoidal ramp 18 formed on the inner wall of the housing 7 in the body 3 of the weapon, so as to be able to translate the munitions in the chutes 16 during the rotation of the loading unit 10.

With reference to FIGS. 1, 2, 6 and 7, the loading and firing system SC comprises several chambers or chamber carriers 20, for example four. Each chamber 20 (FIG. 6) is formed of an elongated cylindrical body 22 drilled with a central channel 24 which forms the chamber itself designed to receive a munition M. The body 22 of each chamber 20 comprises at its periphery two projecting bosses 26 which are axially aligned and each drilled with an opening 28 to allow a stay 30, around which the associated chamber 20 is mounted pivoting, to pass freely through. The chambers 20 can be advantageously formed from a composite material (coiled filaments).

The four chambers 20 and the four associated stays 30 are mounted in the housing 8 in the body 3 of the weapon, and are evenly distributed around the fixed central shaft 12 in parallel to the latter. The stays 30 are integral in rotation with the loading unit 10 mounted in the housing 7 in the body 3 of the weapon.

During rotation of the loading unit 10, the chambers 20 are guided between two fixed cams, respectively inner 32 and outer 34, separated from one another by an even distance which corresponds to the outer diametre of the chambers 20.

The fixed inner cam 32 is, for example, formed of two disks 32*a* integral with the fixed central shaft 12 and separated from one another by a distance which is shorter than the length of the chambers 20.

The fixed outer cam 34 is, for example, formed of two ribs 34*a* projecting from the inner wall of the housing 8 and separated from one another by a distance which is shorter than the length of the chambers 20. Each rib 34*a* encompasses a disk 32*a* and is located roughly opposite the latter.

Thus, cams 32 and 34 mark out between them two inner and outer cam ways which guide the chambers 20 during rotation of the loading unit 10 and define four successive areas covering 360°:

(1) a loading area ZC where a first chamber 20 is open and laterally offset with respect to the associated barrel T of the weapon allowing a munition to be loaded, (2) a closing area ZF where a second chamber 20 containing a munition moves from its open position to its closed position as it approaches the associated barrel T, (3) a firing area ZT where a third chamber 20 is closed and axially aligned with the associated barrel T of the weapon, and (4) an opening area ZO where the fourth chamber 20 moves from its closed position to its open position as it moves away from the associated barrel T.

A spring 35 having two blades 36 and 37 is mounted on each stay 30 between the two bosses 26 of the associated chamber 20. Towards one end, the blade 36 of the spring 35 presses on the fixed central shaft 12, whereas towards the other end, the blade 37 of the spring 35 presses on the body 22 of the chamber 20. The purpose of these springs 35 will be explained later.

The ammunition feed system SA is diagrammatically represented in FIGS. 1 to 4. This feed system SA comprises a lateral opening 38 provided in the weapon body 3 at the level of the loading unit 10. This inlet opening 38 extends in parallel to the chutes 16 in the loading unit 10 and is of a length greater than that of a munition so as to take into account the recoil movement of the weapon further to firing a munition. The feed system SA comprises an external magazine (not shown) and means to provide a continuous flow of munitions into the inlet opening 38, munitions which are thereafter received by the chutes 16 in the loading unit 10 during rotation of the latter.

Figure 8:
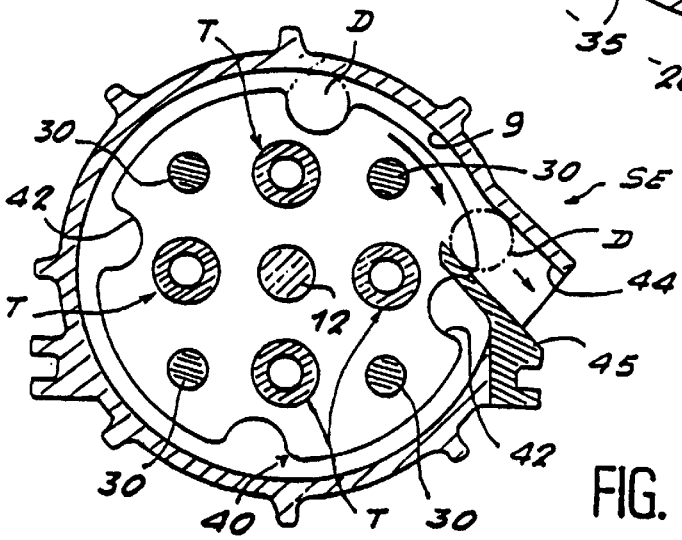
FIG. 8 is a section view along line VII—VII in FIG. 1.

With reference to FIGS. 1 and 8, the system SE to eject the cases of munitions fired from the loading chambers 20, comprises an ejection unit 40 located in the housing 9 in the weapon body 3 and mounted revolving around the fixed central shaft 12. This ejection unit 40 is supported in rotation by the stays 30 which pass right through the unit 40, as well as the four barrels T of the weapon. The unit 40 comprises chutes 42 at its periphery to receive the cases. These chutes 42 extend in parallel to the fixed central shaft 12 and are evenly distributed around the ejection unit 40. The ejection system SE is completed by a lateral outlet opening 44 located at the level of the ejection unit 40. This outlet opening 44 extends in parallel to the chutes 42 for a length at least equal to that of a case. A fixed ejector device 45 located at this outlet opening 44 ensures the ejection of the cases out of the chutes 42 as they pass in front of this opening 44.

A variant embodiment of the system SE to eject the cases is shown in diagram form in FIG. 1. According to this variant, the ejection unit is formed of two star-shaped wheels 46 integral in rotation with the stays 30. The two star-shaped wheels 46 are separated from one another by a distance which is shorter than the length of a case.

Four percussion devices 50 are housed inside the loading unit 10 and are respectively associated with the four chambers 20. When a chamber 20 comes into the firing area ZT marked out by the two cams 32 and 34, a control device 52 (FIG. 1) frees the percussion device 50 associated with this chamber 20 so that it can strike the munition igniter. This control device 52, located on the base 5 of the weapon body 3, comprises, for example, a hinged lever which retains the percussion device 50 in an armed position as long as the chamber 20 has not entered the firing area ZT. This lever supports a cam follower which rolls on a cam whose groove has a side slip which, as the cam follower moves over it, enables the lever to be disengaged thereby freeing the percussion device 50. This percussion of the mechanical type could be replaced by electrical initiation or induction according to the type of munition used.

The housing 9, in which the case ejection system SE is mounted, is closed by a part 55 which also supports the stays 30 as well as the barrels T which extend beyond this part 55 integral in rotation with the loading unit 10, as shown in FIG. 1.

With reference to FIG. 2, an external motor element M, such as a back-geared motor, has a driven shaft which support a drive wheel 56 which engages a toothing 58 provided on the periphery of the support part 55 to drive in rotation the revolving assembly of the weapon comprising the loading unit 10, the stays 30 and the associates chambers 20, the barrels T and the ejection unit 40. It is important to note that the stays 30 ensure the cohesion of this revolving assembly, which rotates around the fixed central shaft 12.

Figure 7:
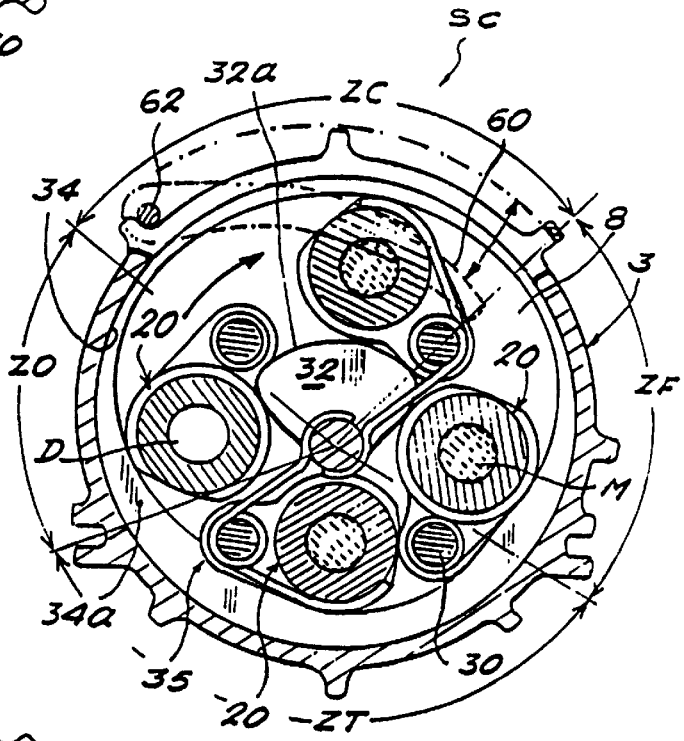
FIG. 7 is a section view along line VII—VII in FIG. 1.

With reference to FIG. 7, a bow-shaped crash stop 60 is mounted pivoting around a shank 62 carried on the weapon body 3. This stop 60 is located to the front of the chambers 20 and in the loading area ZC. The stop 60 partly blocks the front end of the chamber 20 located in the loading area ZC to stop the first munition during loading, this stop 60 being thereafter raised and retained in this position by the cases of the munitions fired.

Figure 9:
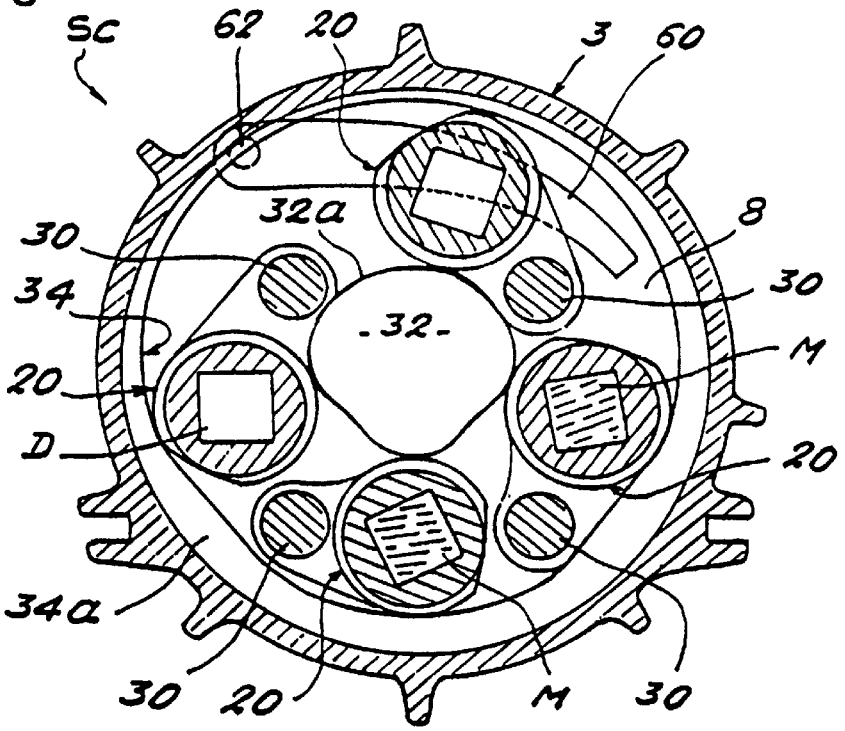
FIG. 9 is a section view similar to that shown in FIG. 7 but according to a variant embodiment of the invention.
Figure 10:
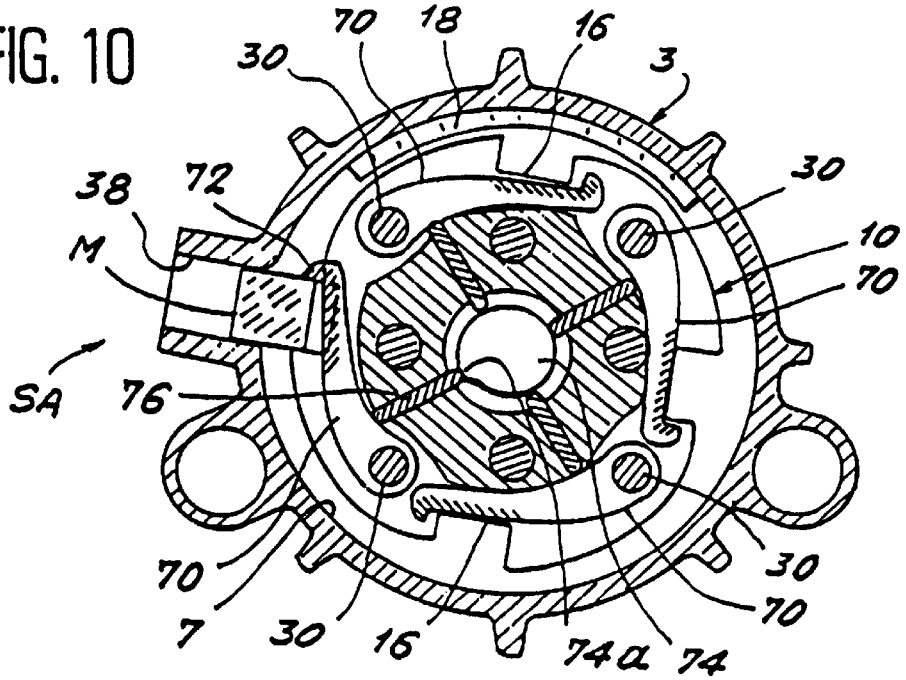
FIG. 10 is a section view corresponding to FIG. 8 according to the variant shown in FIG. 9.

FIGS. 9 and 10 illustrate a variant embodiment for the case of telescoped munitions which are, for example, square-shaped. In this case, the feed system SA (FIG. 10) is completed by levers 70 designed to facilitate the receiving of the munitions in the chutes 16 of the loading unit 10, these chutes having a square-shaped cross section. Each lever 70, there being one such lever per chute 16, is mounted pivoting at one end of a stay 30, whereas its other end is finished off by a positioning hook 72. The four levers 70 are evenly distributed around the loading unit 10 and pivot under the control of a boss 74*a* of a central cam 74 associated with four rods 76. The central cam 74 is fixed and supported by the fixed central shaft 12 of the weapon, and the four rods 76 are mounted sliding inside radial passages arranged in the loading unit 10. Each rod 76 thus presses on the central cam 74 and on the associated lever 70 so as to make the latter pivot radially towards the outside when the rod 76 presses on the boss 74*a* of the central cam 74, i.e. when the hook 72 of the lever 70 is opposite the inlet opening 38 to press on the new munition M entering by the inlet 38 and position this munition M correctly as it it being received by the chute 16 associated with said lever 70.

The operation of the weapon will now be described.

When the motor element M is activated:

the loading unit 10 is driven in rotation around the fixed central shaft 12, the stays 30, integral in rotation with the loading unit 10, are driven in rotation around the fixed central shaft 12 such that the chambers 20 supported by the stays 30 move between the fixed inner 32 and outer 34 cams, the barrels T of the weapon, integral in rotation with the loading unit 10, are driven in rotation around the central fixed shaft 12, and the ejection unit 40, integral in rotation with the loading unit 10, is also driven in rotation around the fixed central shaft 12.

The munitions extracted from the feed magazine enter the inlet 38 in the weapon body 3 in a continuous flow. As soon as a chute 16 in the loading unit 10 moves in front of the inlet opening 38, it receives a munition whose base presses on the fixed helicoidal ramp 18. The revolving movement of the loading unit 10 and the fixed helicoidal ramp 18 causes the munitions to translate in the direction of the loading chambers 20. When a chamber 20 comes into the loading area ZC and moves along this area, this chamber is open and is axially aligned with one of the chutes 16 in the loading unit 10. A munition is thus gradually loaded in the chamber 20 and is fully loaded when it comes into contact with the crash stop located at the front of the chamber 20. Once loaded, the chamber 20 moves into the closing area ZF where the lateral offset with the associated barrel T of the weapon gradually diminishes. The chamber 20 then moves into the firing area ZT where it is axially aligned with the associated barrel T of the weapon. The firing pin P is activated and the munition is fired. The chamber 20 which contains the case of the munition fired then moves into the opening area ZO where it gradually moves offset once again with respect to the associated barrel T. Thereafter, when the chamber 20 once again comes into the loading area ZC, the new munition, which is loaded into the chamber 20, gradually pushes through the case of the munition fired previously. When the chamber 20 moves through the loading area ZC, it is axially aligned with a chute 42 in the revolving ejection unit 40 which receives the case which is then ejected through the outlet opening 44.

Each cycle corresponds to a full revolution of the loading unit 10, a first chamber 20 moves through the loading area ZC, for example, a second chamber 20 moves through the closing area ZF, a third chamber 20 moves through the firing area ZT and the fourth chamber 20 moves through the opening area ZO, and so on.

The purpose of the springs 35 associated with the chambers 20 is to reduce the friction stress of the chambers 20 on the outer cam 34 and to overcome the centrifugal force applied to the chambers 20 during rotation of the loading unit 10.

The loading and firing cycles follow one another to make a rapid burst of fire, the four barrels T of the weapon successively firing one munition during one full revolution of the loading and firing system SC, given that the position in which the percussion takes place is identical for all the barrels T of the weapon.

What is claimed is:

1. A multi-barrel weapon for firing telescoped munitions, comprising at least an ammunition feed system and a loading and firing system having several chamber carriers, wherein the loading and firing system is housed inside a body of the weapon and comprises a loading unit which is mounted able to revolve around a fixed central shaft and which is integral in rotation with the barrels of the weapon, and in which each chamber carrier, during one full revolution of the loading unit, moves from a loading and firing position where the chamber carrier is open and laterally offset with respect to the barrels of the weapon so as to be able to load a munition, to a firing position where the chamber carrier is closed and in axial alignment with one of the barrels of the weapon so as to be able to fire a munition, said chamber carrier, being guided during its movement by guiding means, wherein each chamber carrier being guided during its movement by guiding means, wherein each chamber carrier is mounted pivoting around a stay integral with the revolving loading unit, and is axially alienable with a barrel of the weapon, and wherein the guiding means of the chamber carriers comprises a fixed inner cam, carried by the central shaft, and a fixed outer cam provided on the inner surface of the weapon body and which encompasses the inner cam whilst remaining separated from the inner cam by a distance roughly corresponding to the outer diameter of the chamber carriers.

2. The weapon according to claim 1, wherein the number of chamber carriers is equal to the number of barrels of the weapon.

3. The weapon according to claim 2, wherein each chamber carrier comprises a cylindrical body whose periphery carries two axially aligned bosses, both of which are drilled with a hole to allow the associated stay to pass through freely.

4. The weapon according to claim 3, wherein the fixed inner cam comprises two disks carried by the fixed central shaft and separated from one another by a distance which is shorter than the length of the chambers carriers, each disk defining at its periphery a cam groove around the central shaft.

5. The weapon according to claim 4, wherein the fixed outer cam comprises two ribs disposed on the inner wall of the body of the weapon and separated from one another by a distance which is shorter than the length of the chamber carriers, each rib defining by the edge of its free end a second cam groove which encompasses one of the disks of the fixed inner cam.

6. The weapon according to claim 1, wherein the two fixed inner and outer cams mark out four areas through which each chamber carrier passes one after the other during the full revolution of the loading unit, the four areas comprising:

a loading area in which the chamber carrier is open and laterally offset with respect to the associated barrel of the weapon in order to receive a munition, a closing area in which the chamber carrier gradually closes as it approaches the associated barrel, a firing area in which the chamber carrier is axially aligned with the associated barrel of the weapon, and an opening area in which the chamber carrier gradually opens as it moves away from the associated barrel.

7. The weapon according to claim 1, wherein the loading unit is housed inside the body of the weapon, mounted to the rear of the chamber carriers with respect to the weapon's line of fire and comprises, on a periphery thereof, chutes extending in parallel to the central shaft, evenly distributed around the unit to receive ammunition and working in conjunction with a fixed helicoidal ramp provided on the inner wall of the body of the weapon and designed to translate the munitions towards the loading chamber carriers during rotation of the loading unit.

8. The weapon according to claim 7, wherein one of the chutes of the loading unit is axially aligned with one of the chamber carriers when the latter moves through a loading area marked out by the inner and outer (34) cams.

9. The weapon according to claim 7, wherein the ammunition feed system comprises a lateral inlet provided in the body of the weapon and located on a level with the loading unit, the lateral inlet extending in parallel to the central shaft and is at least as long as a munition, this inlet allowing the munition to pass through, one by one, between an ammunition magazine and the chutes of the loading unit.

10. The weapon according to claim 9, wherein the length of the lateral inlet is greater than that of a munition so as to take into account the recoil movement of the weapon.

11. The weapon according to claim 1, further comprising a system to eject the cases of the munitions fired, the eject system being housed in the body of the weapon, located to the front of the chamber carriers with respect to the line of fire of the weapon and comprising an ejection unit mounted revolving around the fixed central shaft.

12. The weapon according to claim 11, wherein the ejection unit comprises means for supporting the case at its periphery, said means for supporting being axially aligned with that of the chamber carrier located in a loading area marked out by the fixed inner and outer cams.

13. The weapon according to claim 12, wherein the ejection unit comprises two star-shaped wheels integral with the central shaft, and separated from one another by a distance shorter than the length of a case, thereby forming a support to receive a case pushed through by a new munition during loading.

14. The weapon according to claim 12, wherein the ejection system also comprises a lateral outlet provided in the weapon body and located at a level with the ejection unit, the outlet extending in parallel to the central shaft and of a length at least equal to that of a case, and a fixed ejector device to eject a case outwards when the case passes in front of the outlet.

15. The weapon according to claim 1 the stays which support the chamber carriers extend in parallel to the fixed central shaft and ensure the cohesion of a revolving assembly of the weapon, the assembly comprising the loading unit, the chamber carriers, the barrels and an ejection system.

* * * * *